United States Patent [19]

Hill

[11] 4,281,570

[45] Aug. 4, 1981

[54] ROTARY BLADE POWER SAW ATTACHMENT

[76] Inventor: Jay L. Hill, 2401 33rd Ave., North, Texas City, Tex. 77590

[21] Appl. No.: 129,023

[22] Filed: Mar. 10, 1980

[51] Int. Cl.[3] ..... B27B 5/22

[52] U.S. Cl. ..... 83/477.2; 83/574; 144/286 R

[58] Field of Search ..... 83/477.2, 574; 144/286 R

[56] References Cited

U.S. PATENT DOCUMENTS

| | | | |
|---|---|---|---|
| 1,801,721 | 4/1931 | Caldwell | 83/574 X |
| 2,810,412 | 10/1957 | Roug | 83/522 X |
| 3,349,819 | 10/1967 | Koons | 83/477.2 X |
| 3,734,151 | 5/1973 | Skripsky | 144/286 R X |
| 4,069,849 | 1/1978 | O'Grady | 144/286 R X |
| 4,128,029 | 12/1978 | Gay et al. | 83/477.2 X |

*Primary Examiner*—Frank T. Yost

*Attorney, Agent, or Firm*—Larry Mason Lee

[57] ABSTRACT

An attachment to a rotary blade power saw (either hand-held or belt-driven) which allows said saw to be utilized in conjunction with any of the commonly available workbenches (such as that disclosed in U.S. Pat. No. 3,615,087 and sold by The Black and Decker Manufacturing Company of Towson, Md., as the "WORKMATE" all-purpose Work Center and Vise), which workbenches consist of a pair of elongated vise members mounted on a supporting structure such that one or both of the elongated vise members are moveable relative to the other, to yield the equivalent, with attendant benefits, of a common table saw.

5 Claims, 3 Drawing Figures

ROTARY BLADE POWER SAW ATTACHMENT

BACKGROUND OF THE INVENTION

The invention is of an attachment for a rotary blade power saw (either hand-held or belt-driven). Said attachment consists of a uniquely shaped platform having means for mounting the above-mentioned saw beneath the platform; having "legs" or support members beneath the platform which rest upon the supporting structure of a workbench such as that disclosed in U.S. Pat. No. 3,615,087; and having an opening for the protrusion of a rotary saw blade. The "workbench" above and hereinafter referred to is herein deemed to be comprised of a pair of elongated vise members mounted on a supporting structure such that one or both of the elongated vise members are moveable relative to the other, the upper surface of said elongated vise members being planar and useful as a table.

The invention, being an attachment for a rotary blade power saw, allows the utilization of such a saw, in conjunction with a workbench, as a common table saw.

Attachments for rotary blade power saws are suggested in the prior art by several prior inventions. For example, U.S. Pat. No. 4,079,648 discloses a miter attachment for use with a portable electric circular saw and U.S. Pat. No. 4,135,419 discloses a jig for use with circular saws.

Further, there is substantial prior art disclosing various forms of workbenches to which a rotary blade power saw may be attached, for example, U.S. Pat. Nos. 4,068,550; 3,342,226; 3,734,151; and 4,133,360.

However, the only known prior art disclosing an attachment for a hand-held power tool, which attachment allows or facilitates the utilization of the power tool in conjunction with a workbench is U.S. Pat. No. 4,069,849 which purports to disclose an arrangement for cutting contours in a workpiece with a router.

Prior art which is known, all above-mentioned, fails to provide an inexpensive portable attachment to a rotary blade power saw, which attachment allows or facilitates the utilization of such a saw, in conjunction with a workbench, as a common table saw.

SUMMARY OF THE INVENTION

Hand-held, electrically powered circular saws are commonly available today at low cost. Workbenches whose upper surface is comprised of a pair of elongated vise members have recently become popular and commonly available at low cost. Many persons, having both a circular saw and a workbench, would like to have a table saw, but such is available only at a substantially greater cost. The instant invention attaches to a circular saw allowing its use in conjunction with a workbench of the type above-described to yield the benefits and utility of a table saw.

Accordingly, it is a principle object of this invention to provide an attachment to a rotary blade power saw, which attachment allows or facilitates the utilization of such a saw, in conjunction with a workbench, as a common table saw.

Further, it is an object of this invention to provide an attachment to a rotary blade power saw, which attachment allows or facilitates the utilization of such a saw, in conjunction with a workbench, as a miter saw.

Another object of this invention is to provide an attachment for a rotary blade power saw which is easily and quickly attachable to the common hand-held electrically powered circular saw.

Another object of this invention is to provide an attachment for a rotary blade power saw which is lightweight and portable.

Yet another object of this invention is to provide an attachment for a rotary blade power saw which attachment provides a rip fence.

A yet further object of this invention is to provide an attachment for a rotary blade power saw which saw together with attachment can be quickly and easily set up for use, in conjunction with a workbench, as a table saw.

Other and further objects of this invention may be ascertained from a consideration of the following description of the preferred embodiment.

DESCRIPTION OF THE PREFERRED EMBODIMENT

Figure 1:
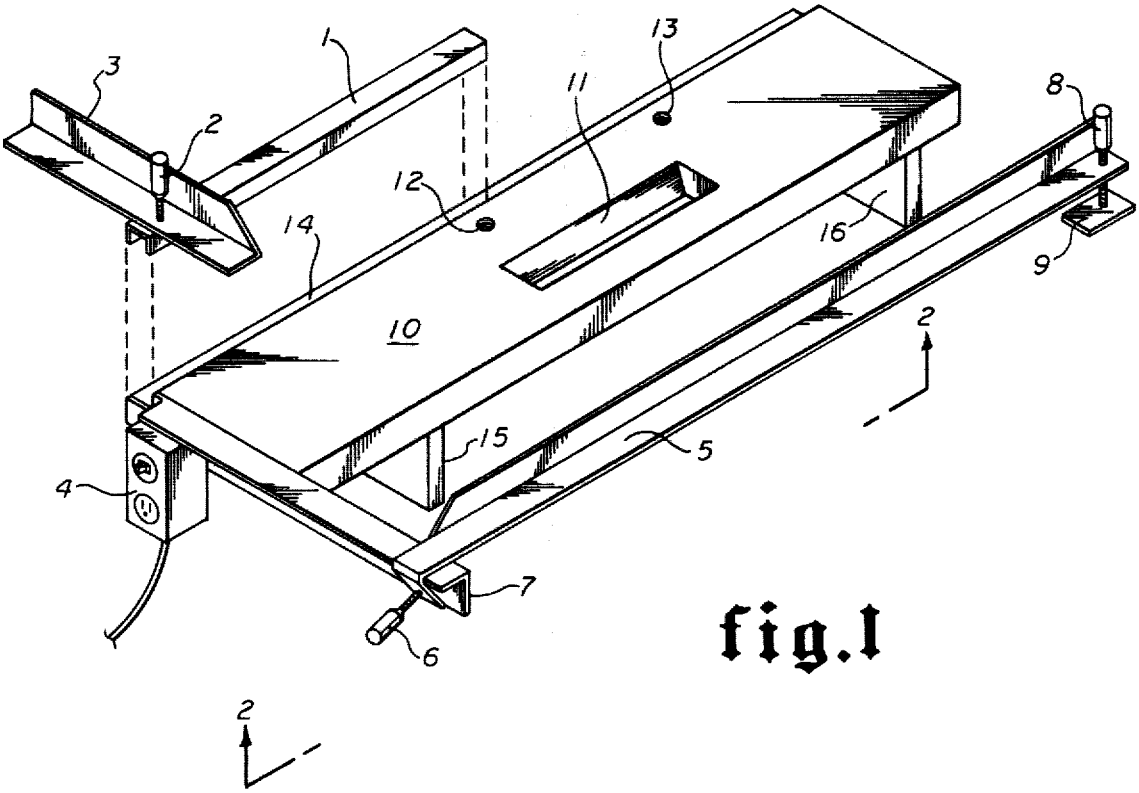
FIG. 1 is a perspective view of the invention.
Figure 2:
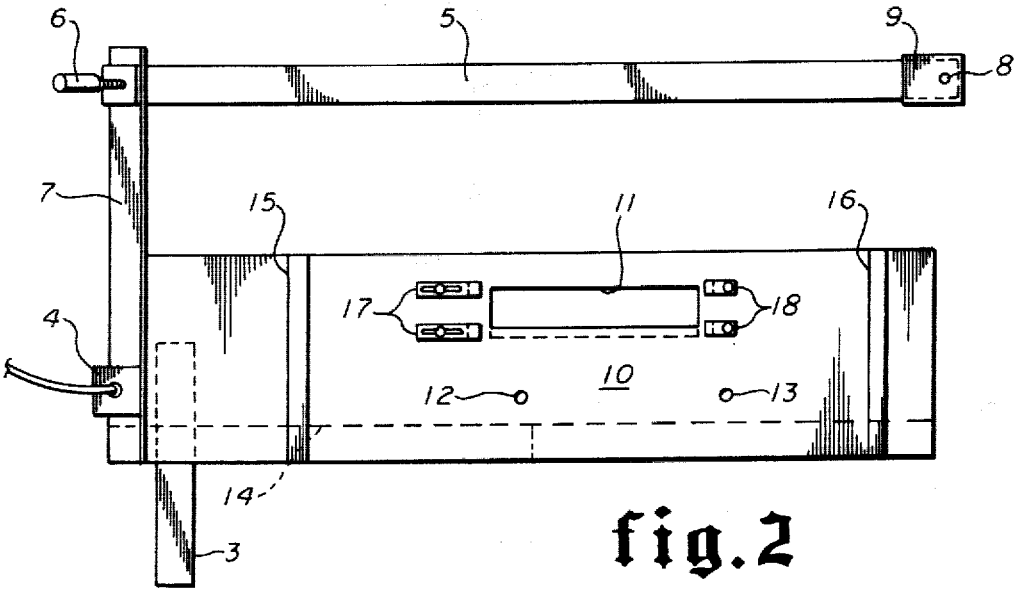
FIG. 2 is a bottom elevational view of the invention.
Figure 3:
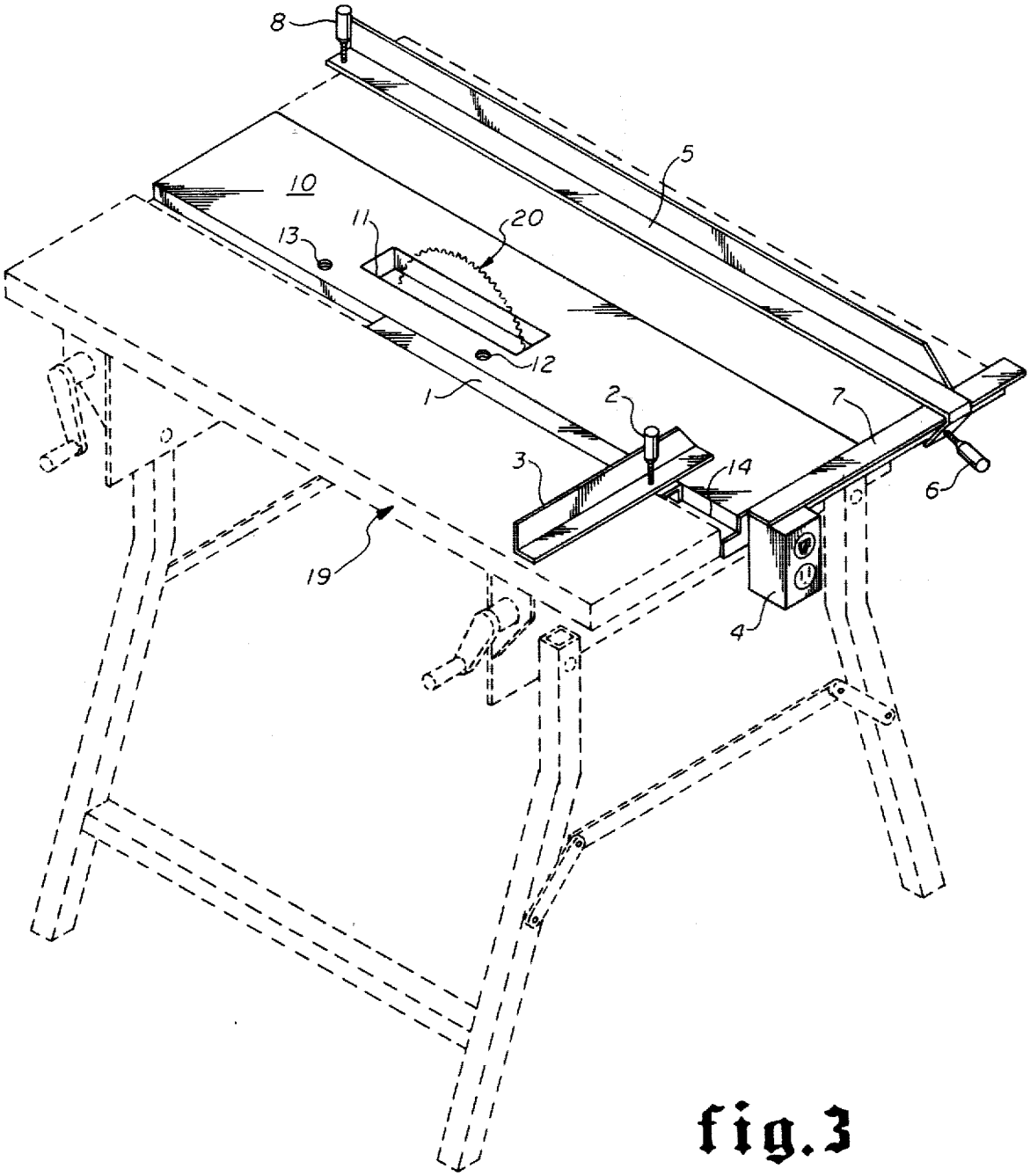
FIG. 3 is a perspective view of the invention installed in position for use on a workbench.

The present invention comprises a platform 10 which has an opening 11 suitable for the protrusion of a circular saw blade 20, means for attaching a rotary blade power saw (12,13,17, and 18) to the platform 10, and leg members (15 and 16) which are connected to the lower surface of the platform 10.

The platform 10 is constructed of rigid or semi-rigid material, has a planar upper surface, is rectangular in shape and has sufficient thickness to be clamped between the elongated vise members comprising the upper surface of a workbench 19. Further, the platform 10 has an opening 11 through which a circular saw blade 20 may protrude, thereby, when the platform 10 is clamped between the elongated vise members of a workbench 19, providing the basic attributes of a table saw.

Leg members (15 and 16) are connected to the lower surface of the platform 10 to support the combined weight of the invention and the attached rotary blade power saw. The leg members (15 and 16) are of such length as will reach and rest upon the underlying support structure of the workbench 19 and as will support the platform 10 in such fashion that the upper surface of the platform is level with the upper surface of the workbench 19.

The bottom surface of the platform 10 provides fastener means (17 and 18) whereby a rotary blade power saw may be fastened to the platform 10 in such manner as will allow the circular saw blade 20 to protrude through the opening 11 in the platform 10. Further fastener means (12 and 13) are provided on the bottom surface of the platform 10 in a position laterally displaced from plane of rotation of the circular saw blade 20 when said blade 20 is protruding through the opening 11. The lateral displacement of the fastener means (12 and 13) provides additional stability to the rotary blade power saw relative to the platform 10.

A rip fence, comprised of a fence member 5, a support member 7, and a lateral adjustment means 6, may be provided by the invention. The support member 7 rigidly fixes the position of the fence member 5 so that the fence member 5 extends above the plane of the upper surface of the platform 10. The support member 7 further serves to rigidly attach the rip fence to the platform 10. The lateral adjustment means 6 serves to allow adjustment of the position of the fence member 5 along the length of the support member 7. The preferred embodiment, as depicted in FIG. 1, contemplates that the lateral adjustment of the fence member 5 will also be affected by the placement of the clamp, consisting of a screw 8 and a plate 9, which can be attached to the workbench 19. The clamp may be located at any point along the length of the fence member 5, in the preferred embodiment the clamp is located at the end of the fence member 5 opposite the end connected to the lateral adjustment means 6.

A miter guage (1, 2, and 3) comprised of a guide member 1, a lateral adjustment means 2, and a fence member 3 may be provided by an upwardly opening groove 14 in the platform 10 adapted to receive and slideably engage the guide member 1. The guide member 1 acts, when slideably engaged with the groove 14, to align and stabilize the miter guage. The fence member 3 is rigidly connected to the guide member 1 in a position variable by the lateral adjustment means 2.

An electrical connection box 4 may be rigidly affixed to the platform 10 for operator convenience in controlling the on-off function of the rotary blade power saw. The electrical connection box 4 of the preferred embodiment is a combination connection box and electrical switch.

I claim:

1. An attachment to a rotary blade power saw, which attachment comprises a platform having a planar upper surface an opening suitable for the protrusion of a circular saw blade through the platform, a fastener means suitable for fastening a rotary blade power saw to the underside of the platform, and support legs attached to the underside of the platform; wherein said support legs are of a length and shape adapted to rest on the underlying support structure of a workbench while maintaining the upper surface of the platform in a plane containing the smooth upper surface of the workbench; wherein said workbench comprises a pair of elongated vise members mounted on a support structure and disposed in side-by-side relation to each other with at least one of said vise members defining a substantially smooth upper surface upon which a work-piece can be placed and at least one of said vise members being mounted on said support structure so as to be moveable relative to the other one of said vise members.

2. An attachment as defined in claim 1, wherein the upper surface of the platform has a groove therein to slideably receive the guide member of a miter guage comprised of a guide member, a lateral adjustment means, and a fence member.

3. An attachment as defined in claim 1, wherein a rip fence is connected thereto; said rip fence being comprised of a support member, a lateral adjustment means, and a fence member.

4. An attachment as defined in claim 1, wherein the platform is rectangular in shape.

5. An attachment as defined in claim 1, wherein the platform has attached thereto an electrical connection box and switch.

* * * * *